US005371331A

United States Patent [19]

Wall

[11] Patent Number: 5,371,331

[45] Date of Patent: Dec. 6, 1994

[54] MODULAR MUFFLER FOR MOTOR VEHICLES

[76] Inventor: Alan T. Wall, 24291 Donner Ct., Laguna Niguel, Calif. 92677

[21] Appl. No.: 81,239

[22] Filed: Jun. 25, 1993

[51] Int. Cl.[5] ..... F01N 7/08

[52] U.S. Cl. ..... 181/227; 181/228; 181/252; 181/257; 181/264; 181/267; 181/268

[58] Field of Search ..... 181/227, 228, 243, 248, 181/249, 250, 251, 252, 256, 267, 258, 264, 267, 268, 282

[56] References Cited

U.S. PATENT DOCUMENTS 1,922,848 8/1933 Harley ..... 181/228

3,786,791 1/1974 Richardson ..... 181/228

*Primary Examiner*—Khanh Dang

*Attorney, Agent, or Firm*—Edgar W. Averill, Jr.

[57] ABSTRACT

A muffler for use on the exhaust system of the motor vehicle. The muffler has a central pipe which is surrounded by an outer pipe which leaves an annular space between the two. The outer pipe is open at both ends and the annular space is filled with a sound deadening material. The central pipe has openings which pass to the annular space and a perforated sound deadening member is affixed to the inner surface of the central pipe. Preferably, the outer pipe is outwardly flared at its upstream end, and the perforated sound deadening member is conical in shape.

2 Claims, 1 Drawing Sheet

DIRECTION OF TRAVEL
AIR
EXHAUST GASES
AIR

MODULAR MUFFLER FOR MOTOR VEHICLES

BACKGROUND OF THE INVENTION

The field of the invention is motor vehicle parts and the invention relates more particularly to mufflers for motor vehicles.

Muffler designs of many configurations exist in the prior art. Some mufflers which contain conical sound deadening members include U.S. Pat. Nos. 1,922,848; 1,953,264; 2,185,584; 2,933,148; 4,325,459 and 4,979,587.

Automobile enthusiasts like to have the ability to modify their muffler so that it matches their vehicle and the type of driving which they intend to do. For some types of driving, they wish to have degree of muffling and for others, a low degree. They also like to be able to vary the back pressure to optimize the performance of their vehicle.

SUMMARY OF THE INVENTION

It is the object of the present invention to provide a muffler design which not only provides an excellent degree of sound deadening, but also gives a low back pressure and which muffler may be modified by the owner.

The present invention is for a muffler for use on the exhaust system of a motor vehicle. The muffler has a central pipe which is generally cylindrical and has an upstream and an exhaust end. The central pipe has a plurality of openings passing through the side wall thereof. The outer pipe is affixed coaxially over the central pipe so that there is an annular space between the central pipe and the outer pipe. This annular space is opened at both ends of the muffler and a sound deadening material is located in this annular space. A perforated sound deadening member is affixed to the inner surface of the central pipe. Preferably, this sound deadening member is conical in shape and affixed near the exhaust end of the central pipe so that it can be moved and replaced and preferably conical members with different degrees of openings are provided.

DESCRIPTION OF THE PREFERRED EMBODIMENT

Figures 1, 2, 3, 4:
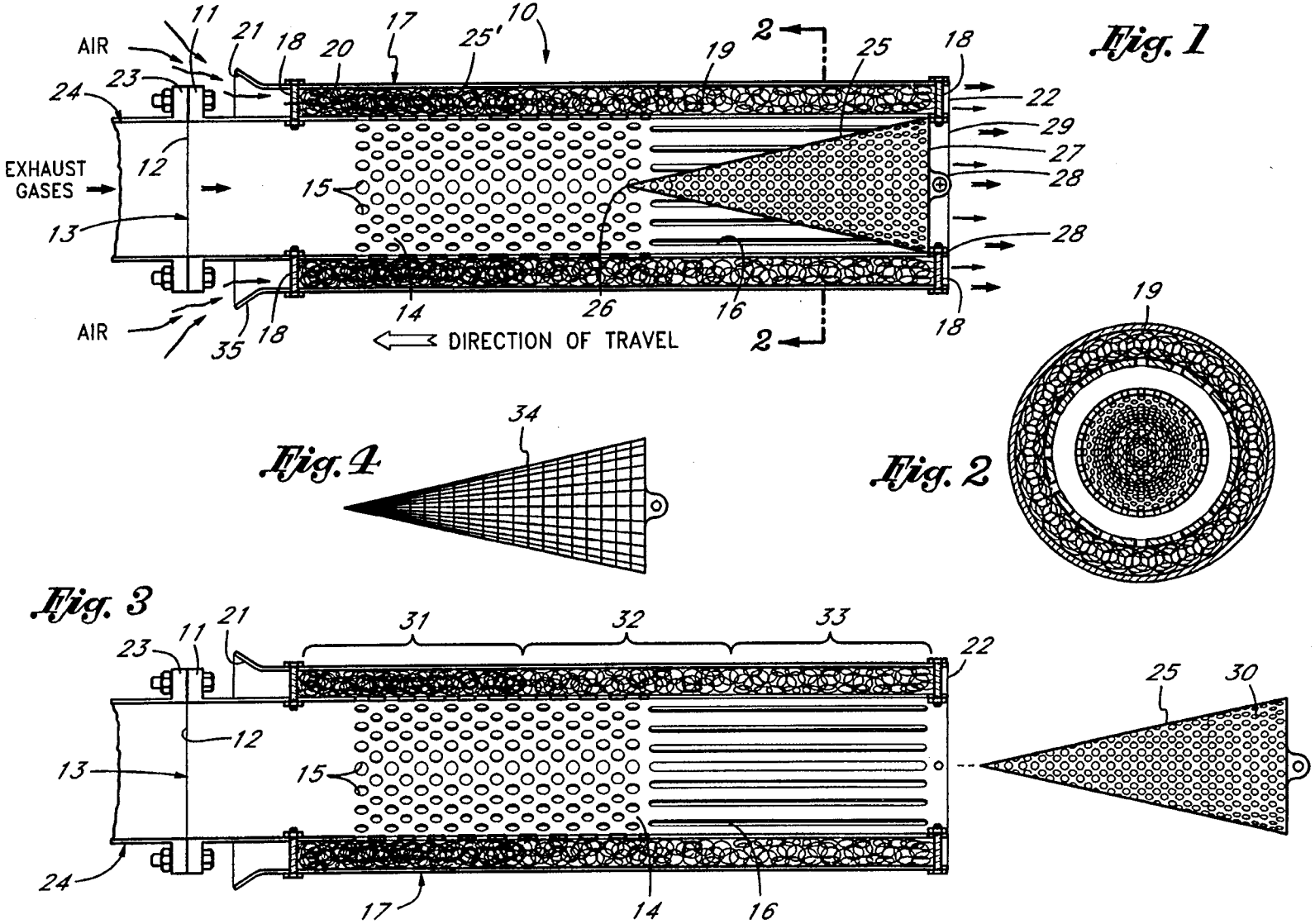
FIG. 1 is a cross sectional side view of the modular muffler of the present invention.
FIG. 2 is a cross sectional view taken along line 2—2 of FIG. 1.
FIG. 3 is a cross sectional view of the muffler of FIG. 1 with the conical member removed.
FIG. 4 is a side view of an alternate embodiment of the cone of the muffler of FIG. 3.

The muffler of the present invention is shown in cross sectional side view and indicated generally by reference character 10. Muffler 10 has a flange 11 affixed at the upstream end 12 of its central pipe 13. Central pipe 13 is generally cylindrical and has a side wall 14 which has a plurality of circular openings 15 which pass therethrough. It also has a plurality of slots 16 which also pass through sidewall 14. An outer pipe 17 is also generally cylindrical and is held to the central pipe by a plurality of screws 18. The inside diameter 25 of outer pipe 17 is preferably about 1 ½ inches larger than the outside diameter 26 of central pipe 13. Outer pipe 17 is positioned coaxially with central pipe 13 which leaves an annular space indicated by reference character 19 in FIG. 2. This annular space is filled with a sound deadening material 20 which is preferably more dense near the upstream end 21 of outer pipe 17 than it is at the exhaust end 22 of outer pipe 17. Flange 11 is affixed to a flange 23 on tail pipe 24 although, of course, other attachments may be used.

Preferably, the upstream 21 end of outer pipe 17 is flared as indicated by reference character 35 to facilitate the passage of air into annular space 19.

A perforated sound deadening member 25, is conical in shape and has an apex 26, and a circular base 27. Four tabs 28 permit the affixing of sound deadening member 25 to the central pipe 13. Preferably, this attachment is adjacent the exhaust end 29 of central pipe 13. This permits the owner to remove and replace the sound deadening member with another member which may have a larger degree of openings or a smaller degree of openings and they also may be varied in shape to permit the owner to tune the muffler, depending on his desires.

The conical sound deadening member 25 is shown as a stainless steel plate formed into a cone with a plurality of openings or holes 30 which redirect the exhaust gases and muffle the sound. The sound deadening member may also be fabricated from a screen material or other configuration depending upon the amount of sound deadening and back pressure desired.

As shown in FIG. 3, the sound deadening material 20 is provided in three different densities indicated by reference characters 31, 32, and 33. The sound deadening material is preferably more dense nearer the upstream end 21 of outer pipe 17 and least dense at the exhaust end 22 thereof. It is also desirable that the central pipe 13 has greater percentage of openings nearer the exhaust end than its upstream end.

An alternate embodiment of the conical sound deadening member 25 is shown in FIG. 4 and indicated by reference character 34. Member 34 is fabricated from a metal screen having an opening of ¼ inch.

The modular muffler of the present invention also permits the user to remove outer pipe 17 from central pipe 13 to modify the sound deadening material in this annular space. Thus, the muffler is highly tunable by the owner and provides an exceptional combination of back pressure and a highly desirable amount of sound deadening.

The term "generally circular" is intended to include the classic oval shape in which most conventional mufflers are formed. The term "conical" is also intended to include a cone with an oval cross-sectional shape.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A muffler for use on the exhaust system of a motor vehicle affixed to the tailpipe thereof, said muffler comprising:

a central pipe which is generally cylindrical and has a side wall, an inner surface, an outer surface, an upstream end and an exhaust end and an outside diameter, said central pipe being affixable to the tailpipe of a motor vehicle and said central pipe having a plurality of openings passing through the side wall thereof, said openings comprising circular holes near the upstream end and elongated slots near the exhaust end;

an outer pipe which is also generally cylindrical and held by said central pipe, said outer pipe having an upstream end and an exhaust end and said outer pipe having an inside surface with an inside diameter which is larger than the outside diameter of the central pipe, said outer pipe being held coaxially with the central pipe thereby leaving an annular space between the outer surface of the central pipe and the inside surface of the outer pipe and said annular space being open at an upstream end and an exhaust end and said annular space containing a sound deadening material; and a perforated sound deadening member affixed to the inner surface of said central pipe.

2. A muffler for use on the exhaust system of a motor vehicle affixed to the tailpipe thereof, said muffler comprising:

a central pipe which is generally cylindrical and has a side wall, an inner surface, an outer surface, an upstream end and an exhaust end and an outside diameter, said central pipe being affixable to the tailpipe of a motor vehicle and said central pipe having a plurality of openings passing through the side wall thereof;

an outer pipe which is also generally cylindrical having an upstream end and an exhaust end and held by said central pipe, said outer pipe having an upstream end and an exhaust end and said outer pipe having an inside surface with an inside diameter which is larger than the outside diameter of the central pipe, said outer pipe being held coaxially with the central pipe thereby leaving an annular space between the outer surface of the central pipe and the inside surface of the outer pipe and said annular space being open at an upstream end and an exhaust end and said annular space containing a sound deadening material, said sound deadening material being more densely packed in an upstream end than at an exhaust end, and said outer pipe being outwardly flared at its upstream end; and a foraminous, cylindrically shaped sound deadening member affixed to the inner surface of said central pipe, said cylindrically shaped sound deadening member having an apex and a circular base and said circular base being affixed to said central pipe so that the apex is pointing upstream.

* * * * *